United States Patent [19]

Sakuma

[11] Patent Number: 5,059,743

[45] Date of Patent: Oct. 22, 1991

[54] TREATMENT OF HYDROCARBON FUEL

[75] Inventor: Tetsuo Sakuma, Osaka, Japan

[73] Assignee: Shinfuji Kogyo Kabushiki Kaisha, Osaka, Japan

[21] Appl. No.: 509,439

[22] Filed: Apr. 16, 1990

[30] Foreign Application Priority Data

| | | | |
|---|---|---|---|
| Apr. 17, 1989 | [JP] | Japan | 1-96693 |
| Apr. 17, 1989 | [JP] | Japan | 1-96694 |
| Apr. 28, 1989 | [JP] | Japan | 1-110688 |
| Aug. 22, 1989 | [JP] | Japan | 1-215324 |

[51] Int. Cl.[5] ..... C07C 7/20; B01J 19/08; B01D 35/06

[52] U.S. Cl. ..... 585/899; 422/186.01; 123/536; 123/537; 123/538; 44/300; 44/321; 210/222; 261/DIG. 80; 208/294

[58] Field of Search ..... 585/899; 422/186.01; 123/536, 537, 538; 44/50, 67; 210/222; 261/DIG. 80

[56] References Cited

U.S. PATENT DOCUMENTS

| | | | |
|---|---|---|---|
| 2,926,276 | 2/1960 | Moriya et al. | 123/536 |
| 4,188,296 | 2/1980 | Fujita | 210/222 |
| 4,254,393 | 3/1981 | Robinson | 210/222 |
| 4,372,852 | 2/1983 | Kovacs | 210/222 |
| 4,569,737 | 2/1986 | Sakata | 585/899 |
| 4,808,306 | 2/1989 | Mitchell et al. | 123/538 |

FOREIGN PATENT DOCUMENTS

| | | | |
|---|---|---|---|
| 59-29762 | 2/1984 | Japan | 123/536 |
| 63-61766 | 3/1988 | Japan . | |

OTHER PUBLICATIONS

Patent Abstracts of Japan, vol. 5, No. 164 (C-76)[836], Oct. 21, 1981; & JP-A-56 92 997 (Takesaburou Furukawa) 28-07-1981.

*Primary Examiner*—Anthony McFarlane
*Assistant Examiner*—Nhat Phan
*Attorney, Agent, or Firm*—Armstrong, Nikaido, Marmelstein, Kubovcik & Murray

[57] ABSTRACT

The present invention relates to a method of treating a hydrocarbon fuel to minimize the consumption of the fuel, in which a magnet having a very weak magnetic flux density, and the magnetic density at the S pole is larger than that at the N pole is used, and using the magnet of the present invention the fuel cost can be reduced to about 70-80% in comparison with the non-treated fuel.

4 Claims, No Drawings

TREATMENT OF HYDROCARBON FUEL

BACKGROUND OF THE INVENTION

The present invention relates to the treatment of a hydrocarbon fuel, especially to improve combustion efficiency, minimizing fuel cost and conserve petroleum.

It has been proposed to treatment a fuel with a magnet as a method of reducing fuel cost for car engines, Japanese Patent Publication No. 205712/1985. However, such a proposal has not been actually practiced, because trials only show unreliable results as well as the lack of theoretical basis. Therefore, the proposal has been neglected as an error due to inaccuracies in the experimental conditions. Actually, tests on cars using a conventionally available magnet does not show any significant result in the reduction of fuel cost.

SUMMARY OF THE INVENTION

It has been found that a significant reduction of fuel cost by about 20–30% with high reproducibility can be achieved by the treatment of a hydrocarbon with a specific magnet which has magnetic flux densities of about 5–18 gauss at the S magnetic pole and about less than 6 gauss at the N pole. That is, the present invention provides a method of improving the combustion efficiency of a hydrocarbon fuel to conserve petroleum.

DETAILED DESCRIPTION OF THE INVENTION

The present invention relates to a method of treatment of a hydrocarbon fuel which comprises treating a hydrocarbon fuel with a magnet having a magnetic flux density of about 5–18 gauss, and more preferably about 5–15 gauss at the S magnetic pole, and a magnetic flux density of about less than 6 gauss at the N magnetic pole under the condition that the ratio of the latter to the former does not exceed 0.5, and a device usable for such a treatment.

The hydrocarbon fuel according to the present invention means a fuel containing a hydrocarbon as a main component, and includes petroleum distillates, dry distillation or decomposition products of coal, heavy oil, light oil, kerosene, gasoline, natural gas or PL gas and the like.

The method of treatment of the hydrocarbon fuel with the magnet comprises putting the specific magnet into or setting it onto a fuel tank such as a fuel tank of cars, a stock tank including a storing tank or a storage tank in a gas station, or a circulation pipe or a distillation line such as a coolant or a reservoir. In order to treat the fuel with magnet the fuel may be not always directly exposed to or contacted with the magnet, but the fuel may be stocked in a vessel or circulated in a pipe, which are made of a material lower in a magnetic permeability as controlling the magnetic induction onto the fuel within a given level. Such a control may be achieved by adjusting the distance between the vessel or pipe and the magnet. The use of magnet is the most preferable way to expose the fuel to magnetic circumstances, but an electromagnet can be used or a desirable magnetic circumstances may be formed by a magnetic inducement.

A magnetic metal usable for the present invention has an extremely lower magnetic flux density than that of a conventional magnet, and in addition the magnetic flux density at the S pole is higher than that at the N pole.

Such a magnet is not usual, but it can be made by contacting an end portion of a long metal having a low residual magnetic flux density with the N pole of a magnetization device. The magnitude of the magnetic flux density at the S pole can be controlled by selecting the sort of metal, the residual magnetic flux density, the magnetic flux density of the magnetization device at the N pole, the period of contact with the N pole. The magnitude of the magnetic flux density at the N pole can be also controlled by selecting the sort of metal to be used as a magnet, a magnetic flux density of magnetization device at the N pole, contacting time, the ratio of the length and the area of a cross section of the metal to be magnetized and the like. Further, a magnet having a magnetic flux density at the S pole equal to that at the N pole can be used by changing the distances from the N pole and the S pole to the fuel to be treated in a suitable range. However, in such a case the N pole does not usually contact the fuel.

In order to contact or expose the fuel to a magnetic field the magnetic metal may be preferably arranged such that the fuel can be exposed to a given magnetic flux density at any position. This can be achieved by stirring agitation, or circulation of a fuel in a tank. The effect of the present invention can be achieved even by the use of a small amount of a magnetic metal by stirring for a sufficient time.

The time for exposing the fuel to magnetic field may be very short when a sufficient amount of magnetic metal is used, and as the amount of the magnetic metal to be used is reduced, the period of exposure may be extended. There is however, a tendency to decrease the effect achieved by the treatment with a magnet with time when the fuel is left outside the magnetic field after the treatment with the magnet. Accordingly, too small a magnet will be able to provide only insufficient effect to the fuel even if the exposing period is extended. In general, a magnetic field having a given magnetic flux density may be preferably used in the amount of more than 300 g or more preferably than 500 g per 1 liter of fuel. The amount of the magnetic metal may be controlled according to the shape of the magnetic metal, manner of arrangement, treatment such as settlement or circulation of a fuel, exposing period and the like. When the magnetic metal is installed in a fuel tank of a car, it does not need as much treatment because the fuel can be used simultaneously with the treatment, whereas when the fuel is treated with the magnetic metal in a stock tank it is preferably treated using a comparatively large amount of magnetic metal for long period, because it is often used after fairly long time has elapsed since treatment. The effect from the treatment is probably not influenced by temperature, but an extremely lower temperature may decrease the effect, and at and extremely higher temperature the effect varies because of the change of fuel components, change of magnetic flux density and the like.

The shape or structure of the device for conserving fuel according to the present invention is not limited. The device, for instance, may be a rod, a comb, a plate, a tube of the magnetic metal as it is, or these may be fixed on a tank wall or inner pipe, or used as a blade of agitator or a obstacle plate.

The present invention is illustrated by the following examples, which should not be construed as limited to these examples. In these examples the magnetic flux densities shown are one of the portion exhibiting the highest density in each magnetic metal used, and are expressed in gauss.

EXAMPLE 1

Combustion Test (I) In case that magnetic metals are used so that the total magnetic flux density is equal at N and S poles (Comparative Example)

Four pieces of each magnetic metal; one has a magnetic flux density of 15 gauss at the S pole and 5 gauss at the N pole ($14\times18\times60$ mm$^3$, 120 g), and the other has a magnetic flux density of 5 gauss at the S pole and 15 gauss at the N pole ($14\times18\times60$ mm$^3$, 120 g), total 960 g were inserted into a fuel tank (146 liter) of a furnace containing 134 liters of light oil. After 15 hours, the temperature of the furnace was raised to 400° C. and then to 1200° C. The time necessary to raise the temperature from 400° C. to 1200° C., light oil consumption, and the amount of residual oxygen in the exhaust gas were determined every 15 minutes (oil pressure 7 kg/cm$^2$, air supplied 14.4 m$^3$N-oil).

The same determination as the above was made in combustion under the same conditions except that a magnetic metal was not used.

The results were shown in Table 1.

The Test Items and Conditions (1) Amount of the residual oxygen: FOA-7 oxygen combustible gas measuring instrument (available from Komyo Rikagaku Kogyo K.K.).

(2) Temperature of furnace: PZT temperature controlling instrument (available from Fuji Denki Seizo K.K.).

(II) In case that the magnetic flux density at the N pole is larger than that at the S pole (Comparative Example)

The same test as described in the above (I) was repeated except that four pieces of each magnetic metal, one having 5 gauss at the S pole and 2 gauss at the N pole ($14\times18\times60$ mm$^3$, 120 g), and the other having 5 gauss at the S pole and 15 gauss at the N pole ($14\times18\times60$ mm$^3$, 120 g), total 960 g were used. The results were shown in Table 1.

(III) In case that the magnetic flux density at the S pole is larger than that at the N pole (Example)

The same combustion test as described in (I) was repeated except that four pieces of each magnetic metal, one having 15 gauss at the S pole and 5 gauss at the N pole ($14\times18\times60$ mm$^3$, 120 g), and the other having 2 gauss at the S pole and 5 gauss at the N pole ($14\times18\times60$ mm$^3$, 120 g), total 960 g were used. The results were shown in Table 1.

(IV) In case that the magnetic flux density at the S pole is larger than that at the N pole, and larger than 18 gauss The same combustion test as described in (I) was repeated except that eight pieces of magnetic metal having 27 gauss at the S pole and 8 gauss at the N pole ($14\times18\times60$ mm$^3$, 120 g), total 960 g were used. The results were shown in Table 1.

TABLE 1

| blank | | | | Comparative Example I | | | | Comparative Example II | | | |
|---|---|---|---|---|---|---|---|---|---|---|---|
| min. | temp. °C. | consp. liter | oxygen % | min. | temp. °C. | consp. liter | oxygen % | min. | temp. °C. | consp. liter | oxygen % |
| 0 | 400 | 0 | 8.0 | 0 | 400 | 0 | 8.0 | 0 | 400 | 0 | 8.0 |
| 15 | 910 | 6.83 | 5.0 | 15 | 920 | 7.00 | 5.0 | 15 | 920 | 7.00 | 5.0 |
| 30 | 1070 | 13.66 | 3.2 | 30 | 1085 | 14.00 | 3.2 | 30 | 1085 | 14.00 | 3.2 |
| 45 | 1160 | 20.33 | 2.7 | 45 | 1190 | 20.83 | 2.7 | 45 | 1145 | 20.83 | 2.7 |
| 52 | 1200 | 23.33 | 2.5 | 48 | 1200 | 22.16 | 2.2 | 56 | 1200 | 26.33 | 2.2 |

| Example III | | | | Example IV | | | |
|---|---|---|---|---|---|---|---|
| min. | temp. °C. | consp. liter | oxygen % | min. | temp. °C. | consp. liter | oxygen % |
| 0 | 400 | 0 | 8.0 | 0 | 400 | 0 | 8.0 |
| 15 | 940 | 7.17 | 4.4 | 15 | 910 | 7.33 | 4.7 |
| 30 | 1110 | 14.34 | 2.4 | 30 | 1065 | 13.83 | 3.0 |
| 42 | 1200 | 19.84 | 1.8 | 45 | 1165 | 20.83 | 2.5 |
| | | | | 52 | 1200 | 23.83 | 2.3 |

min.: combustion time,
temp.: furnace temperature,
consp.: light oil consumption,
oxygen: amount of residual oxygen in the exhaust gas.

As apparent from the results shown in Table 1, the consumption amounts of the light oil were reduced by 5%, 15 and 2% in (I), (III), and (IV) respectively, whereas it the same was increased by 13% in (II).

EXAMPLE 2

Following tests were carried out using a commercially available light oil of the same lot.

A magnetic metal having a magnetic flux density of 8 gauss at the S pole and 2 gauss at the N pole ($14\times18\times120$ g) was hung at a central portion of aluminum vessel (18 liter) containing 17 liter of light oil for 1 hour, 2 hours, 3 hours, 5 hours and 7 hours to give 5 kinds of light oil treated with a magnetic metal.

The temperature of an inner furnace was raised to 600° C., and then to 1100° C. using a light oil of the same lot, which had not been treated with the magnetic metal (non-treated light oil). The combustion was carried out under the condition of oil pressure being 7 kg/cm$^2$, air supplied 13.4 m$^3$N-oil). The combustion time, consumption of the light oil and the amount of residual oxygen in the exhaust gas were determined every 5 minutes.

The same combustion tests were repeated using the above light oil treated with a magnetic metal, and finally the same test was repeated with the light oil.

The same test was repeated two times, and the mean value of the both was shown in Table 2 (1)–(3). The instruments used for the determination of the amount of the residual oxygen and the furnace temperature are the same as used in the Example 1.

TABLE 2 (1)

| | | (consumption of a light oil (1)) | | | | | |
|---|---|---|---|---|---|---|---|
| time | non- | treating time with magnetic metal | | | | | non- |
| (min.) | treated | 1 hr. | 2 hr. | 3 hr. | 5 hr. | 7 hr. | treated |
| 0 | 0 | 0 | 0 | 0 | 0 | 0 | 0 |
| 5 | 2.50 | 2.17 | 2.33 | 2.00 | 2.33 | 2.33 | 2.17 |

TABLE 2 (1)-continued

| time (min.) | non-treated | (consumption of a light oil (1)) treating time with magnetic metal 1 hr. | 2 hr. | 3 hr. | 5 hr. | 7 hr. | non-treated |
|---|---|---|---|---|---|---|---|
| 10 | 4.83 | 4.00 | 4.66 | 4.17 | 4.66 | 4.50 | 4.50 |
| 15 | 7.16 | 6.17 | 6.99 | 6.50 | 6.66 | 6.83 | 7.00 |
| 17 | — | — | — | — | — | 8.00 | — |
| 18 | — | — | — | — | 8.33 | — | — |
| 20 | 9.47 | — | — | 9.00 | — | — | 9.17 |
| 21 | — | — | 9.32 | — | — | — | — |
| 22 | — | 9.84 | — | — | — | — | — |
| 24 | 11.29 | — | — | — | — | — | 11.17 |
| index* | 100 | 87.2 | 82.6 | 79.7 | 73.8 | 70.9 | 98.9 |

*Consumption amount of the light oil was expressed in liters. Index is expressed by a converted value assuming the amount of the non-treated oil is 100, which is consumed to increase the furnace temperature to 1100° C.

TABLE 2 (2)

| time (min.) | non-treated | (residual amount of oxygen (%)) treating time with magnetic metal 1 hr. | 2 hr. | 3 hr. | 5 hr. | 7 hr. | non-treated |
|---|---|---|---|---|---|---|---|
| 0 | 7.0 | 7.0 | 7.0 | 7.0 | 7.0 | 7.0 | 7.0 |
| 5 | 4.5 | 4.5 | 4.5 | 4.2 | 4.0 | 4.0 | 4.8 |
| 10 | 4.2 | 4.0 | 4.0 | 3.8 | 3.5 | 3.5 | 4.2 |
| 15 | 4.0 | 3.6 | 3.5 | 3.5 | 3.3 | 3.0 | 3.8 |
| 17 | — | — | — | — | — | 3.0 | — |
| 18 | — | — | — | — | 3.1 | — | — |
| 20 | 3.8 | 3.3 | — | 3.2 | — | — | 3.5 |
| 21 | — | — | 3.2 | — | — | — | — |
| 22 | — | 3.0 | — | — | — | — | — |
| 24 | 3.7 | — | — | — | — | — | 3.4 |

TABLE 2 (3)

| time (min.) | non-treated | (temperature (°C.)) treating time with magnetic metal 1 hr. | 2 hr. | 3 hr. | 5 hr. | 7 hr. | non-treated |
|---|---|---|---|---|---|---|---|
| 0 | 600 | 600 | 600 | 600 | 600 | 600 | 600 |
| 5 | 860 | 870 | 865 | 860 | 900 | 910 | 850 |
| 10 | 970 | 970 | 970 | 985 | 995 | 1025 | 945 |
| 15 | 1020 | 1030 | 1040 | 1045 | 1070 | 1085 | 1015 |
| 17 | — | — | — | — | — | 1100 | — |
| 18 | — | — | — | — | 1100 | — | — |
| 20 | 1065 | 1080 | — | 1100 | — | — | 1070 |
| 21 | — | — | 1100 | — | — | — | — |
| 22 | — | 1100 | — | — | — | — | — |
| 24 | 1100 | — | — | — | — | — | 1100 |

As apparent from Table 2 (1) the consumption of a light oil can be reduced more effectively by the longer treatment with a magnetic metal, and about 30% reduction of consumption of the light oil can be effected.

EXAMPLE 3

Example 2 was repeated except that nine pieces of magnetic metal having a magnetic flux density of 8 gauss at the S pole and 2 gauss at the N pole ($14\times18\times60$ mm$^3$, 120 g) each were arranged at intervals of 10 cm at right and left and vertically, and immersed into a light oil for 30 minutes and one hours. The results were shown in Table 3.

TABLE 3

| time | non-treatment with magnet temp. °C. | consp. liter | $O_2$ % | treatment with magnetic metal (30 min.) temp. °C. | consp. liter | $O_2$ % | (1 hour) temp. °C. | consp. liter | $O_2$ % |
|---|---|---|---|---|---|---|---|---|---|
| 0 | 600 | 0 | 7.0 | 600 | 0 | 7.0 | 600 | 0 | 7.0 |
| 5 | 850 | 2.17 | 4.8 | 925 | 2.50 | 3.5 | 920 | 2.17 | 3.5 |
| 10 | 945 | 4.50 | 4.2 | 1035 | 4.67 | 3.1 | 1030 | 4.50 | 3.0 |
| 15 | 1015 | 7.00 | 3.8 | 1100 | 7.00 | 2.9 | 1100 | 6.67 | 2.8 |
| 20 | 1070 | 9.17 | 3.5 | | | | | | |
| 24 | 1100 | 11.17 | 3.4 | | | | | | |
| index | | 100 | | | 62.7 | | | 59.7 | |

consp.: consumption of a light oil,
index: Index is expressed by a converted value assuming the amount of the non-treated oil is 100, which is consumed to increase the furnace temperature to 1100° C.

As apparent from the above results, the consumption amount of a light oil can be highly reduced, for instance, to about 40% by a magnetic metal even in a shorter time when the magnetic metals are arranged very close to each other.

A combustion test was repeated according to Example 3 except that the same light oil as in Example 3 was treated with magnetic metals having following magnetic flux density for one hour respectively. The results are shown in Table 4.

| magnetic (G) | S pole (G) | N pole | size (mm$^3$) | number | interval (cm) |
|---|---|---|---|---|---|
| (a) | 3 | 1 | 14 × 18 × 60 | 9 | 10 |
| (b) | 5 | 2 | 14 × 18 × 60 | 9 | 10 |
| (c) | 10 | 3 | 14 × 18 × 60 | 9 | 10 |
| (d) | 12 | 4 | 14 × 18 × 60 | 9 | 10 |
| (e) | 15 | 5 | 14 × 18 × 60 | 9 | 10 |
| (f) | 23 | 7 | 14 × 18 × 60 | 9 | 10 |

TABLE 4

| time (min.) | non-treatment with magnetic metal temp. °C. | consp. liter | $O_2$ % | time (min.) | treated with (a) S pole: 3 gauss N pole: 1 gauss temp. °C. | consp. liter | $O_2$ % | time (min.) | treated with (b) S pole: 5 gauss N pole: 2 gauss temp. °C. | consp. liter | $O_2$ % | time (min.) | treated with (c) S pole: 10 gauss N pole: 3 gauss temp. °C. | consp. liter | $O_2$ % |
|---|---|---|---|---|---|---|---|---|---|---|---|---|---|---|---|
| 0 | 600 | 0 | 7.0 | 0 | 600 | 0 | 7.0 | 0 | 600 | 0 | 7.0 | 0 | 600 | 0 | 7.0 |
| 5 | 850 | 2.17 | 4.8 | 5 | 840 | 2.17 | 4.1 | 5 | 905 | 2.50 | 3.6 | 5 | 915 | 2.50 | 3.8 |
| 10 | 945 | 4.50 | 4.2 | 10 | 945 | 4.50 | 3.3 | 10 | 1005 | 4.83 | 3.1 | 10 | 1025 | 4.83 | 3.0 |
| 15 | 1015 | 7.00 | 3.8 | 15 | 1015 | 6.83 | 3.1 | 15 | 1075 | 7.16 | 2.8 | 15 | 1090 | 7.16 | 2.8 |
| 20 | 1070 | 9.17 | 3.5 | 20 | 1070 | 9.00 | 2.9 | 18 | 1100 | 8.66 | 2.6 | 16 | 1100 | 7.66 | 2.8 |

TABLE 4-continued

| | | | | | | | | | | | | | | | | | |
|---|---|---|---|---|---|---|---|---|---|---|---|---|---|---|---|---|---|
| 24 | 1100 | 11.17 | 3.4 | 23 | 1100 | 10.50 | 2.7 | | | | | | | | | | |
| index | | 100 | | index | | 94 | | index | | 77.5 | | index | | 68.6 | | | |
| | | | | | treated with (d) S pole: 12 gauss N pole: 4 gauss | | | | treatment with (e) S pole: 15 gauss N pole: 5 gauss | | | | treated with (f) S pole: 23 gauss N pole: 7 gauss | | |
| | | | | time (min.) | temp. °C. | consp. liter | $O_2$ % | time (min.) | temp. °C. | consp. liter | $O_2$ % | time (min.) | temp. °C. | consp. liter | $O_2$ % | | |
| | | | | 0 | 600 | 2.33 | 7.0 | 0 | 600 | 0 | 7.0 | 0 | 600 | 0 | 7.0 | | |
| | | | | 5 | 895 | 4.66 | 3.8 | 5 | 880 | 2.17 | 4.0 | 5 | 850 | 2.17 | 4.0 | | |
| | | | | 10 | 1000 | 6.83 | 3.2 | 10 | 985 | 4.50 | 3.2 | 10 | 940 | 4.67 | 3.5 | | |
| | | | | 15 | 1070 | 7.00 | 3.0 | 15 | 1050 | 6.83 | 2.9 | 15 | 1005 | 7.00 | 3.1 | | |
| | | | | 18 | 1100 | 8.03 | 2.8 | 20 | 1100 | 9.33 | 2.3 | 20 | 1065 | 9.17 | 3.0 | | |
| | | | | | | | | | | | | 23 | 1100 | 10.83 | 2.8 | | |
| | | | | index | | 71.9 | | index | | 83.5 | | index | | 97.0 | | | |

consp.: consumption of a light oil,

Index is expressed by a converted value assuming the amount of the non-treated oil is 100, which is consumed to increase the furnace temperature to 1100° C.

The above results indicate that the effect of a magnetic metal treatment on the combustion efficiency decreases gradually as the magnitude of magnetic flux density at the S pole increases, and when the magnetic flux density at the S pole exceeds 27 gauss or the magnetic flux density at the N pole exceeds 8 gauss, a desirable effect could not be obtained.

EXAMPLE 4.1

Nine pieces of magnetic metal each having a magnetic flux density of 10 gauss at the S pole and 3 gauss at the N pole (each 120 gr) was arranged at intervals of 10 cm in right and left up and down in an aluminum vessel of 18 liters containing 17 liters of a light oil, and immersed for one hour. Two batches of the treated light oil (total 34 liters) were prepared. One batch was charged into a fuel tank for a light oil just after the treatment with the magnetic metal, and after the temperature of the furnace increased to 60° C., the combustion time, the consumption of the light oil, the amount of remaining oxygen in the exhaust gas were determined every 5 minutes (oil pressure 7 kg/cm$^2$, air supplied 13.4 m$^3$N/oil). The other batch was held for 4 days after removing the magnetic metal, and then combustion test was repeated according to the same manner as the above. The test condition of the both were the same as in Example 2. The results are shown in Table 4.1.

TABLE 4.1

| | non-treatment with magnetic metal | | | | treated with magnetic metal (after 4 days) | | |
|---|---|---|---|---|---|---|---|
| time (min.) | temp. °C. | consp. liter | $O_2$ % | time (min.) | temp. °C. | consp. liter | $O_2$ % |
| 0 | 600 | 0 | 7.0 | 0 | 600 | 0 | 7.0 |
| 5 | 850 | 2.17 | 4.8 | 5 | 855 | 2.50 | 4.5 |
| 10 | 945 | 4.50 | 4.2 | 10 | 950 | 4.67 | 4.0 |
| 15 | 1015 | 7.00 | 3.8 | 15 | 1020 | 7.00 | 3.6 |
| 20 | 1070 | 9.17 | 3.5 | 20 | 1080 | 9.00 | 3.3 |
| 24 | 1100 | 11.17 | 3.4 | 23 | 1100 | 10.50 | 3.2 |
| index | | 100 | | index | | 94 | |

| | treated with magnet (just after) | | |
|---|---|---|---|
| time (min.) | temp. °C. | consp. liter | $O_2$ % |
| 0 | 600 | 0 | 7.0 |
| 5 | 920 | 2.17 | 3.5 |
| 10 | 1030 | 4.50 | 3.0 |
| 15 | 1095 | 7.00 | 2.8 |
| 17 | 1100 | 7.85 | 2.8 |

TABLE 4.1-continued

| | |
|---|---|
| index | 70.3 |

consp.: consumption of a light oil, $O_2$: amount of remaining oxygen in the exhaust gas, index: Index is expressed by a converted value assuming the amount of the non-treated oil is 100, which is consumed to increase the furnace temperature to 1100° C.

EXAMPLE 4.2

A combustion test was repeated according to the Example 4.1 except that the fuel was treated with the magnetic metal for 24 hrs. The results are shown in Table 4.2.

TABLE 4.2

| | non-treatment with magnetic metal | | | | treated with magnetic metal (after 4 days) | | |
|---|---|---|---|---|---|---|---|
| time (min.) | temp. °C. | consp. liter | $O_2$ % | time (min.) | temp. °C. | consp. liter | $O_2$ % |
| 0 | 600 | 0 | 7.0 | 0 | 600 | 0 | 7.0 |
| 5 | 850 | 2.17 | 4.8 | 5 | 885 | 2.50 | 4.0 |
| 10 | 945 | 4.50 | 4.2 | 10 | 995 | 4.67 | 3.8 |
| 15 | 1015 | 7.00 | 3.8 | 15 | 1065 | 7.00 | 3.5 |
| 20 | 1070 | 9.17 | 3.5 | 19 | 1100 | 9.17 | 3.0 |
| 24 | 1100 | 11.17 | 3.4 | index | | 82.1 | |
| index | | 100 | | | | | |

| | Treated with magnet (just after) | | |
|---|---|---|---|
| time (min.) | temp. °C. | consp. liter | $O_2$ % |
| 0 | 600 | 0 | 7.0 |
| 5 | 920 | 2.50 | 3.8 |
| 10 | 1030 | 4.83 | 3.0 |
| 15 | 1095 | 7.16 | 2.8 |
| 16 | 1100 | 7.66 | 2.8 |
| index | | 69 | |

The above results from the Example 4.1 and 4.2 show the combustion efficiency effected by the treatment of a fuel with a magnetic metal is reduced with the time after the magnetic metal is removed from the fuel.

EXAMPLE 5

A combustion test was repeated according to Example 4 except that a heavy oil was used instead of a light oil, and as a magnetic metal following metals (c'), (d'), and (e') were used instead of (c), (d) and (e). The magnetic metals (a), (b) and (f) were the same as those in Example 4. The same lot of the heavy oil was used in each test. The results are shown in Table 5.

| magnetic (G) | S pole (G) | N pole | size ($mm^3$) | number | interval (cm) |
|---|---|---|---|---|---|
| (c') | 8 | 2 | 14 × 18 × 60 | 9 | 10 |
| (d') | 10 | 3 | 14 × 18 × 60 | 9 | 10 |
| (e') | 18 | 6 | 14 × 18 × 60 | 9 | 10 |

TABLE 5

| non-treatment with magnetic metal | | | | treated with (a) S pole: 3 gauss N pole: 1 gauss | | | |
|---|---|---|---|---|---|---|---|
| time (min.) | temp. °C. | consp. liter | $O_2$ % | time (min.) | temp. °C. | consp. liter | $O_2$ % |
| 0 | 600 | 0 | 7.0 | 0 | 600 | 0 | 7.0 |
| 5 | 830 | 2.17 | 4.2 | 5 | 875 | 2.33 | 4.0 |
| 10 | 935 | 4.50 | 3.5 | 10 | 980 | 4.66 | 3.5 |
| 15 | 1010 | 6.83 | 3.2 | 15 | 1045 | 6.99 | 3.3 |
| 20 | 1075 | 9.33 | 3.0 | 21 | 1100 | 10.15 | 2.9 |
| 25 | 1100 | 11.16 | 2.9 | index | | 90.9 | |
| index | | 100 | | | | | |

| treated with (b) S pole: 5 gauss N pole: 2 gauss | | | | treated with (c') S pole: 8 gauss N pole: 2 gauss | | | |
|---|---|---|---|---|---|---|---|
| time (min.) | temp. °C. | consp. liter | $O_2$ % | time (min.) | temp. °C. | consp. liter | $O_2$ % |
| 0 | 600 | 0 | 7.0 | 0 | 600 | 0 | 7.0 |
| 5 | 870 | 2.17 | 3.9 | 5 | 900 | 2.33 | 3.5 |
| 10 | 980 | 4.34 | 3.1 | 10 | 1005 | 4.50 | 3.2 |
| 15 | 1060 | 6.67 | 2.8 | 15 | 1080 | 6.67 | 3.0 |
| 20 | 1100 | 8.97 | 2.5 | 17 | 1100 | 7.54 | 2.8 |
| index | | 80.4 | | index | | 67.6 | |

| treated with (d') S pole: 10 gauss N pole: 3 gauss | | | | treated with (e') S pole: 18 gauss N pole: 6 gauss | | | |
|---|---|---|---|---|---|---|---|
| time (min.) | temp. °C. | consp. liter | $O_2$ % | time (min.) | temp. °C. | consp. liter | $O_2$ % |
| 0 | 600 | 0 | 7.0 | 0 | 600 | 0 | 7.0 |
| 5 | 905 | 2.17 | 3.8 | 5 | 875 | 2.33 | 3.2 |
| 10 | 1015 | 4.34 | 3.1 | 10 | 980 | 4.50 | 3.0 |
| 15 | 1085 | 6.34 | 2.7 | 15 | 1050 | 6.67 | 2.8 |
| 16 | 1100 | 7.01 | 2.7 | 20 | 1085 | 9.00 | 2.5 |
| index | | 62.8 | | 21 | 1100 | 10.00 | 2.4 |
| | | | | index | | 89.6 | |

| treated with (f) S pole: 23 gauss N pole: 7 gauss | | | |
|---|---|---|---|
| time (min.) | temp. °C. | consp. liter | $O_2$ % |
| 0 | 600 | 0 | 7.0 |
| 5 | 860 | 2.17 | 4.0 |
| 10 | 960 | 4.34 | 3.5 |
| 15 | 1020 | 6.34 | 3.2 |
| 20 | 1070 | 8.67 | 3.0 |
| 24 | 1200 | 10.40 | 2.9 |
| index | | 93.2 | |

consp.: consumption of a light oil,
$O_2$: amount of remaining oxygen in the exhaust gas,
index: Index is expressed by a converted value assuming the amount of the non-treated oil is 100, which is consumed to increase the furnace temperature to 1100° C.

As apparent from the above results a magnetic metal having a magnetic flux density of from 3–23 gauss at the S pole and 1–7 gauss at the N pole, and the magnetic flux density at the S pole is larger than it at the N pole can improve combustion efficiency.

EXAMPLE 6

Eight pieces of magnetic metal having a magnetic flux density of 3 and 1 gauss at the S pole and at the N pole respectively (14×18×30 $mm^3$, 60 g) were thrown into a fuel tank (content 55 cc) of a gasoline car for domestic use (Colona 1500 cc, 1984 type, available from Toyota). The car was provided for daily use for 7 days and the consumption was measured. The same test was made using the same car without the magnetic metal for the comparison. The results are shown in Table 6.

index of mileage: a distance which a car can drive by a fuel of 1 liter when the distance driven by a fuel of 1 liter which is not treated with a magnetic metal is assumed as 100.

TABLE 6

| | non-treatment | treated for 7 days |
|---|---|---|
| mileage (km) | 277.5 | 406.0 |
| fuel consumption (liter) | 29.1 | 41.3 |
| mileage per fuel (km/l) | 9.54 | 9.83 |
| index of mileage | 100 | 103 |

EXAMPLE 7

Eight pieces of magnetic metal having a magnetic flux density of 8 and 2 gauss at the S pole and at the N pole respectively (14×18×30 $mm^3$, 60 g) were thrown into a fuel tank (content 55 cc) of a gasoline car for domestic use (Colona 1800 cc, 1986 type, available from Toyota). The car was driven a given mileage on the Hanshin High Way Road and Chugoku-Traversing Road after 20 hours since the magnetic metal was thrown into the tank, and then the consumption was measured. The measurement was started after the car was driven several km. The same test was made using the same car without the magnetic metal for the comparison. The results are shown in Table 7.

TABLE 7

| | non-treatment | treated for 7 days |
|---|---|---|
| mileage (km) | 211.6 | 211.6 |
| average velocity (km/h) | 90 | 90 |
| fuel consumption (liter) | 14.0 | 10.9 |
| mileage per fuel (km/l) | 15.1 | 19.4 |
| index of mileage | 100 | 128 |

EXAMPLE 8

The same tests as these of Example 7 were repeated except that magnetic metals having a magnetic flux density of 23 gauss at the S pole and 7 gauss at the N pole (14×18×30 $mm^3$, 60 g) were used. The results are shown in Table 8.

TABLE 8

| | non-treatment | treated for 7 days |
|---|---|---|
| mileage (km) | 211.6 | 211.6 |
| average velocity (km/h) | 90 | 90 |
| fuel consumption (liter) | 14.0 | 13.5 |
| mileage per fuel (km/l) | 15.1 | 15.7 |
| index of mileage | 100 | 104 |

EXAMPLE 9

Magnetic metals having a magnetic flux density of 9 gauss at the S pole and 2 gauss at the N pole (14×18×30 $mm^3$) 5.5 g/liter and 11.9 g/liter were inserted into fuel tanks of two domestic gasoline cars (1500 cc). After 20 hours from the insertion the cars were driven at a constant velocity under the conditions shown in Table 9 (1). The starting time was 5 am in both case. The results were shown in Table 9 (2).

TABLE 9 (1)

| cars: Nissan Sannt Bans | No. 1 | No. 2 |
|---|---|---|
| type | 1986 | 1988 |
| fuel | regular gasoline | |

TABLE 9 (1)-continued

| cars: Nissan Sannt Bans | No. 1 | No. 2 |
|---|---|---|
| total amount of exhaust gas (l) | 1.48 | 1.48 |
| weight of cars (kg) | 1325 | 1325 |
| the number of riders | 2 | 2 |
| loaded freight weight (kg) | 60 | 60 |
| driving way: | | |
| going up | from Sakai to Shirahama | |
| going back | from Shirahama to Sakai | |

TABLE 9 (2)

| | up | down | up | down |
|---|---|---|---|---|
| amount of magnetic metal (g/l) | 0 (blank) | 5.5 | 0 (blank) | 11.9 |
| mileage (km) | 203.8 | 192.8 | 182.4 | 175.4 |
| consumption of fuel (liter) | 18.4 | 15.0 | 15.3 | 10.8 |
| consumption of fuel (liter) | 11.08 | 12.85 | 11.92 | 16.24 |
| reduction of fuel (%) | 16.0 | 16.0 | 36.2 | 36.2 |

COMPARATIVE EXAMPLE

Consumption of gasoline was measured according to Example 7 except that eight pieces of magnetic metal having a magnetic flux density of 35 gauss at the S pole, and 12 gauss at the N pole ($14\times18\times30$ mm$^3$, 60 g) were used. Throughout the test the same lot of the gasoline and the same car was used. The results are shown in Table 10.

TABLE 10

| | non-treatment | treated for 24 hrs. |
|---|---|---|
| mileage (km) | 211.6 | 168.9 |
| average velocity (km/h) | 90 | 90 |
| fuel consumption (liter) | 14.0 | 13.2 |
| mileage per fuel (km/l) | 15.1 | 12.8 |
| index of mileage | 100 | 84.8 |

As apparent from the above results the mileage per unit fuel decreases when a magnetic metal of large gauss at the S pole was used.

EXAMPLE 10

Eight pieces of a magnetic metal having a magnetic flux density of 13 gauss at the S pole and 4 gauss at the N pole ($14\times18\times60$ mm$^3$, 120 g) were thrown into a fuel tank (200 liter) of a truck (4 ton, 1983 type available from Isuzu). The consumption of a light oil by 6 days drive was determined. The above was repeated except that the treatment with the magnetic metal was not made. The consumptions of the fuel in the both cases are shown in Table 11.

TABLE 11

| | non-treatment | treated for 6 |
|---|---|---|
| mileage (km) | 217 | 461 |
| fuel consumption (liter) | 46.0 | 82.3 |
| mileage per fuel (km/l) | 4.7 | 5.6 |
| index of mileage | 100 | 119.1 |

EXAMPLE 11

Eight pieces of magnetic metal having a magnetic flux density of 13 gauss at the S pole and 4 gauss at the N pole ($14\times18\times30$ mm$^3$, 60 g) were inserted into a LP gas tank (content 80 liter) of a domestic car for LP gas (2000 cc, Nissan Sedoric, 1977 type, available from Nissan). After 15 hours, the car was driven for several km previously, and then for a given distance between the high way interchanges, and the consumption of LP gas for a give distance was determined. The same test was repeated by the same car but no magnetic metal was used. The results were shown in Table 12.

TABLE 12

| | non-treatment | treated for 15 hrs. |
|---|---|---|
| mileage (km) | 114.4 | 114.4 |
| average velocity (km/h) | 90 | 90 |
| fuel consumption (liter) | 10.0 | 8.6 |
| mileage per fuel (km/l) | 11.4 | 13.3 |
| index of mileage | 100 | 116.7 |

EXAMPLE 12

Eight pieces of a magnetic metal having a magnetic flux density of 8 gauss at the S pole and 2 gauss at the N pole ($14\times18\times30$ mm$^3$, 60 g) were immersed in a fuel tank of a domestic gasoline car (1500 cc, Civic, type 1982, available from Honda) for 24 hours. The engine of the car was driven, the exhaust gas was collected, and the concentration of $CO_2$, $O_2$, CO, and NOx in the exhaust gas were determined as the revolution of the engine of the car was changed. The same determination was made for an engine using a non-treated gasoline.

Each concentration was determined by the following devices:

CO concentration: CGT-10=2A (a portable type gas tester available from Shimazu Seisakusho), $CO_2$ concentration: the same as the above'

$O_2$ concentration: POT-101 a portable type oxygen meter available from Shimazu Seisakusho, NOx concentration: ECL-77A chemical light-emitting type densitometer for nitrogen oxide.

The results are shown in Table 13 by an average of ten minute determination.

As apparent from the above results the Nox concentration in the exhaust gas was reduced by the treatment of fuel with a magnetic metal.

TABLE 13

| | concentration | | | |
|---|---|---|---|---|
| | $CO_2$ % | $O_2$ % | CO % | NOx ppm |
| non-treated: | | | | |
| 800 rpm | 7.6 | 6.3 | 6.5 | 35 |
| 2000 rpm | 11.2 | 5.2 | 2.0 | 43 |
| 3000 rpm | 13.9 | 0.0 | 4.4 | 134 |
| treated with magnetic metal: | | | | |
| 800 rpm | 4.9 | 10.3 | 4.1 | 23 |
| 2000 rpm | 10.7 | 4.1 | 2.6 | 26 |
| 3000 rpm | 13.9 | 0.0 | 4.3 | 128 |

EXAMPLE 13

The concentration of $CO_2$, $O_2$, CO and NOx in an exhaust gas was determined in a similar manner as in the Example 12, except that a light oil as a fuel and Terester of Ford (2000 cc, 1984 type) were used. Additionally, the concentration of $CH_4$ was determined using SM-2000 graphite analyzing meter available from K.K. Yamato Yoko. The results are shown in Table 14.

TABLE 14

| | concentration | | | | |
|---|---|---|---|---|---|
| | $CO_2$ % | $O_2$ % | CO % | NOx ppm | $CH_4$ % |
| non-treated: | | | | | |
| 600 rpm | 2.40 | 17.22 | 0.038 | 115 | 11.7 |
| 2000 rpm | 2.25 | 17.35 | 0.031 | 83 | 9.0 |

TABLE 14-continued

| | concentration | | | | |
|---|---|---|---|---|---|
| | $CO_2$ % | $O_2$ % | CO % | NOx ppm | $CH_4$ % |
| 3000 rpm | 2.75 | 16.44 | 0.038 | 111 | 17.3 |
| treated with magnetic metal: | | | | | |
| 600 rpm | 2.34 | 17.80 | 0.025 | 98 | 9.3 |
| 2000 rpm | 2.19 | 17.94 | 0.023 | 64 | 10.3 |
| 3000 rpm | 2.58 | 17.37 | 0.019 | 84 | 14.5 |

As apparent from the results the concentrations of the NOx and the $CH_4$ in the exhaust gas were significantly reduced by the treatment of the fuel with a magnetic metal.

What is claimed is:

1. A method of improving the combustion efficiency of a hydrocarbon fuel which comprises exposing the fuel to a magnetic field from a magnet having a magnetic flux density of about 5–18 gauss at the S pole and a magnetic flux density of less than about 6 gauss at the N pole, wherein the ratio of the magnetic flux density at the N pole to the magnetic flux density at the S pole is equal to or less than about 0.5

2. A method according to claim 1, wherein the magnet is located in a tank for the hydrocarbon fuel.

3. A method according to claim 2, wherein the tank is a fuel tank of a car or a truck.

4. A method according to claim 1, wherein the hydrocarbon fuel is gasoline, heavy oil, light oil or kerosene.

* * * * *